United States Patent [19]

Marran

[11] Patent Number: 4,765,308

[45] Date of Patent: Aug. 23, 1988

[54] VENTING SYSTEM WITH NATURAL CONVECTION COOLING

[75] Inventor: John D. Marran, Bernardsville, N.J.

[73] Assignee: Energy Kinetics, Lebanon, N.J.

[21] Appl. No.: 54,858

[22] Filed: May 27, 1987

[51] Int. Cl.[4] ..... F23L 17/02

[52] U.S. Cl. ..... 126/85 B; 126/316

[58] Field of Search ..... 126/85 B, 307 R, 316

[56] References Cited

U.S. PATENT DOCUMENTS

| | | | |
|---|---|---|---|
| 103,943 | 6/1870 | Thrift | 126/316 |
| 393,121 | 11/1888 | Packham | 126/316 |
| 2,687,127 | 8/1954 | Leffler | 126/307 |
| 2,764,972 | 10/1956 | Ryder | 126/307 |
| 2,818,060 | 12/1957 | Field | 126/307 R |
| 2,966,838 | 1/1961 | Thompson et al. | 98/62 |
| 2,998,764 | 9/1961 | Bedell et al. | 98/62 |
| 3,046,976 | 7/1962 | Aggson | 126/316 |
| 3,052,230 | 9/1962 | Conrad | 126/307 |
| 3,056,397 | 10/1962 | Little | 126/85 |
| 3,082,758 | 3/1963 | Heiman | 126/110 |
| 3,211,079 | 10/1965 | Carlson | 98/46 |
| 3,429,307 | 2/1969 | Eubanks | 126/85 B X |
| 3,435,816 | 4/1969 | Werth | 126/85 B |
| 3,522,767 | 8/1970 | Derringer | 98/58 |
| 3,552,377 | 1/1971 | Hodges | 126/85 |
| 3,643,646 | 2/1972 | Honaker | 126/85 B |
| 3,662,735 | 5/1972 | Jackson | 126/85 B |
| 3,680,541 | 8/1972 | Honaker | 126/85 B |
| 3,994,280 | 11/1976 | Winters et al. | 126/307 A |
| 4,163,440 | 8/1979 | Stultz | 126/60 |
| 4,261,299 | 4/1981 | Marran | 122/134 |
| 4,262,608 | 4/1981 | Jackson | 110/162 |
| 4,425,875 | 1/1984 | Marran | 122/134 |
| 4,608,963 | 2/1986 | Townsend et al. | 126/307 R |

FOREIGN PATENT DOCUMENTS

| | | | |
|---|---|---|---|
| 557259 | 5/1957 | Belgium | 126/85 B |

OTHER PUBLICATIONS

Tjernlund Products, Inc., "Sidewall Vent Systems", Form No. HS-SV-83, Copyright 1985, 5 pages.

Tjernlund Products, Inc., 4 pages.

The Field Controls Company, "Power Venters and Draft Inducers", Form 4110, USA, 1985, 6 pages.

*Primary Examiner*—Harold Joyce

*Attorney, Agent, or Firm*—Dickstein, Shapiro & Morin

[57] ABSTRACT

A venting system using natural convection cooling is disclosed in which a sleeve is inserted within a flue pipe. The annulus between that sleeve and the flue pipe is sealed at an inside end and the flue pipe is provided with a plurality of vent holes in the periphery of its outer end, which is positioned outside a building. That annulus forms a cooling passage and outside air is drawn through the annulus by a natural convection process to dramatically lower the flue pipe temperature. The outer end of that sleeve is open to a vent hood. An outer wall sleeve is also positioned around the flue pipe and sealed at one end in order to form an annulus containing an insulating air layer. That reduces the heat conduction to the outer wall sleeve, substantially reducing the outer wall sleeve temperature. The venting system also includes a vent hood having a double hood in which the outermost hood is spaced from the inner one. By arranging the outer hood to be open at the top and bottom, a natural convection process provides cooling air which rises through the space between the inner and outer walls, preventing convective and radiant heat from the inner hot hood from being transmitted to the outer hood, and reducing the temperature of the outer hood to a level which permits touching without injury.

22 Claims, 2 Drawing Sheets

VENTING SYSTEM WITH NATURAL CONVECTION COOLING

BACKGROUND OF THE INVENTION

The present invention relates generally to a venting system which provides natural convection cooling. More particularly, the present invention relates to a venting system which expels combustion gases generated by a combustion process and in which the temperature of the outer wall sleeve of the venting system is reduced substantially.

The present invention is particularly useful in eliminating the need for a conventional chimney as found in newly constructed buildings, as well as in homes and other buildings that are being converted to utilize fossil fuels (i.e., oil, natural gas or propane) for heating and hot water making and which have not been constructed with chimneys. The use of the venting system of the present invention is advantageous when venting the products of combustion from a furnace, a heating unit, a boiler, a hot water heater or an incinerator through a combustible wall, since the temperature of the outer wall sleeve is substantially reduced from previously known systems.

In a typical building heating system, a furnace is located inside a building with a combustion chamber to which a flue pipe is connected so that the combustion gases generated in the combustion chamber of the furnace may flow through the flue pipe to a chimney up through the roof and be expelled into the atmosphere. Chimneys are made of brick and ceramic tile, or expensive insulated metal. Typical older style boilers or furnaces had high temperature flues—500° F. and above, which required the use of a roof venting system. The more efficient modern; non-condensing appliances have combustion temperatures of about 350° F.-400° F. or below.

Such temperatures create problems as the combustion gases travel through the system for release into the atmosphere since the hot combustion gases raise the temperature of the flue pipe to such an extent that there is a risk of fire when the flue pipe passes through the combustible wall of the building. In addition, the heat generated by the combustion gases is also radiated to the exterior of the vent hood, thus creating a risk of burns to anyone touching the vent hood.

In the past, several systems have been constructed in which combustion air from the atmosphere is fed into a combustion chamber via an inlet duct. The flue products from the combustion chamber are expelled through another duct to the atmosphere. The combustion air inlet duct is generally located between the combustible wall or roof and the flue pipe so that the incoming combustion air serves to cool and reduce the wall or roof temperature. However, such devices do not use any specific cooling chambers and the air is not exhausted from the system by means of natural convection, as in the present invention. The only air that comes in through the inlet duct is used for combustion purposes.

Such systems differ from the system of the present invention in that the air in the vent hood is circulated between the flue pipe and the sleeve and is not later circulated to the combustion chamber. That air exits through the holes provided by the present invention which, in addition, causes the heated air to rise by a natural convection process and exit at the top of the vent. Typical of such prior art devices are the systems shown in the following: Stultz, U.S. Pat. No. 4,163,440; Ryder, U.S. Pat. No. 2,764,972; Hodges, U.S. Pat. No. 3,552,377; Little, U.S. Pat. No. 3,056,397; Jackson, U.S. Pat. No. 3,662,735; DeWerth, U.S. Pat. No. 3,435,816; Carlson, U.S. Pat. No. 3,211,079; Jackson, U.S. Pat. No. 4,262,608; and Winters et al., U.S. Pat. No. 3,994,280.

In another prior art system, as disclosed in U.S. Pat. No. 2,966,838 to Thompson, et al., a stagnant air gap between the flue pipe and the wall is used for cooling. However, because the heated air cannot escape from within the gap, hot air remains in the air gap and thus provides only limited cooling.

The present invention also provides natural convection cooling for the vent hood itself, which is attached to the flue pipe on the outside wall of the building. Various prior art designs for vent hoods are presently known. One such example is that disclosed in U.S. Pat. No. 3,056,397 to Little, in which the vent hood utilizes air inlet ducts at both the inner top portion and an inner bottom portion of the vent hood. Combustion gases are expelled at both an outer top portion and an outer bottom portion of the vent hood. Although the air inlet ducts cool the inner portion of the vent hood, the outer portion is not cooled to any great extent.

Another known design is disclosed in U.S. Pat. No. 2,998,764 to Bedell, et al., in which cool air is fed from the top inner portion and the bottom outer and inner portions of the vent hood and passes into a combustion chamber. Combustion gases are expelled through the top outer portion of the vent hood. However, Bedell, et al. does not disclose any method to cool the top outer portion of the vents through which the flue gases exit.

SUMMARY AND OBJECTS OF THE INVENTION

There still exists a need for an apparatus for exhausting flue gases to the atmosphere by the gases passing through a wall of a building with the building-flue pipe wall interface being maintained at a safe temperature in order to prevent combustion of the wall materials. It is, therefore, a primary object of this invention to provide apparatus for enabling the exhausting of flue gases through a building wall in which the temperature at the flue pipe-building interface is maintained at such a temperature that the risk of combustion of the building wall materials is substantially reduced.

More particularly, it is the object of this invention to provide a venting system which draws in outside cool air and creates convection currents through the venting system for substantially reducing the temperature of the flue pipe at the building-flue pipe interface and thereby substantially eliminating the risk of fire of the building materials.

Another object of the present invention is to provide a vent hood for the venting system of the present invention which is cooled by means of natural convection currents such that it is maintained at a safe temperature.

A further object of the present invention is to provide a venting system in which a stream of outside air is caused to move upwardly through the system by natural convection means in order to cool the air surrounding a flue pipe.

A still further object of the present invention is to provide a venting system having a vent hood in which a stream of air is caused to move upwardly through the system by natural convection in order to cool the vent hood.

Briefly described, these and other objects of the invention are accomplished by the venting system of the present invention that utilizes a flue pipe, two sleeves and a vent hood. The flue pipe is connected between the combustion chamber of, for example, a furnace, at one end and the vent hood on the outside wall of a building at the other end. The hot combustion gases generated in the furnace pass from the combustion chamber of the furnace to the vent hood and then into the atmosphere.

A first sleeve is inserted within the flue pipe. The annulus between that sleeve and the flue pipe is sealed at its inside end and is vented by six holes in the periphery of the outer end of the flue pipe such that those holes are positioned outside the building. This annulus forms a cooling passage so that outside air is drawn through the annulus by a natural convection process, thereby dramatically lowering the flue pipe temperature as the combustion gases pass through the wall of the building. The outer plate of the system, which, without this sleeve system, would conduct the high temperatures of the combustion gases through conductivity to the combustable wall is considerably cooler with the use of the instant sleeve system.

In addition, an outer wall sleeve is positioned around the flue pipe and sealed at one end in order to form an annulus containing an insulating air layer open to the inside of the building. It is the outer wall sleeve that is actually in contact with the building wall and extends through the building wall to the vent hood located on the outside of the building wall. The use of this stagnant insulating air layer formed between the outer sleeve and the flue pipe causes a dramatic reduction in the heat conducted from the flue pipe to the outer wall sleeve. The result of using this type of arrangement is that, for typical flue temperatures, the temperature of the outer wall sleeve is reduced to approximately 60° F. above the air temperature.

In addition, a vent hood is utilized which includes a double external surface. The outermost surface is spaced from the inner surface and is open at the top and bottom. With such an arrangement, a natural convection process is achieved which provides a flow of cooling air that rises through the space between the inner and outer external surfaces of the vent hood. This flow of cool air removes convective and radiant heat from the inner hot surface before most of that heat is transmitted to the outer surface. The result is that the outer surface temperature is reduced to a level which permits the surface to be safely touched. In another embodiment, external openings are provided in a wallplate between the flue pipe and the outer sleeve, for bringing outside air into the room in which the combustion chamber is located, in order to provide combustion air.

The present invention therefore provides the advantage of reducing the temperature of the surfaces in contact with the combustible wall of the building adjacent to the flue pipe from approximately 200° F. to approximately 130° F., or about 60° F. over ambient temperature when the combustion gases have a temperature of about 350° F. This advantage is achieved while minimizing the space requirements of the venting system. An important feature of the present invention is the use of the first annulus which provides a steady stream of cool air around the first sleeve, as well as the use of a second annulus which provides an air insulated air space surrounding the flue pipe. The venting system of the present invention provides cooling utilizing a single air space and a compact system.

In addition, the venting system of the present invention dramatically lowers the temperature of the outer surface of the vent hood from approximately 29020 F. to approximately 130° F. or less. Finally, the venting system of the present invention eliminates costly and unsightly vertical chimneys and is easy to install.

DETAILED DESCRIPTION OF THE PREFERRED EMBODIMENT

Figure 1:
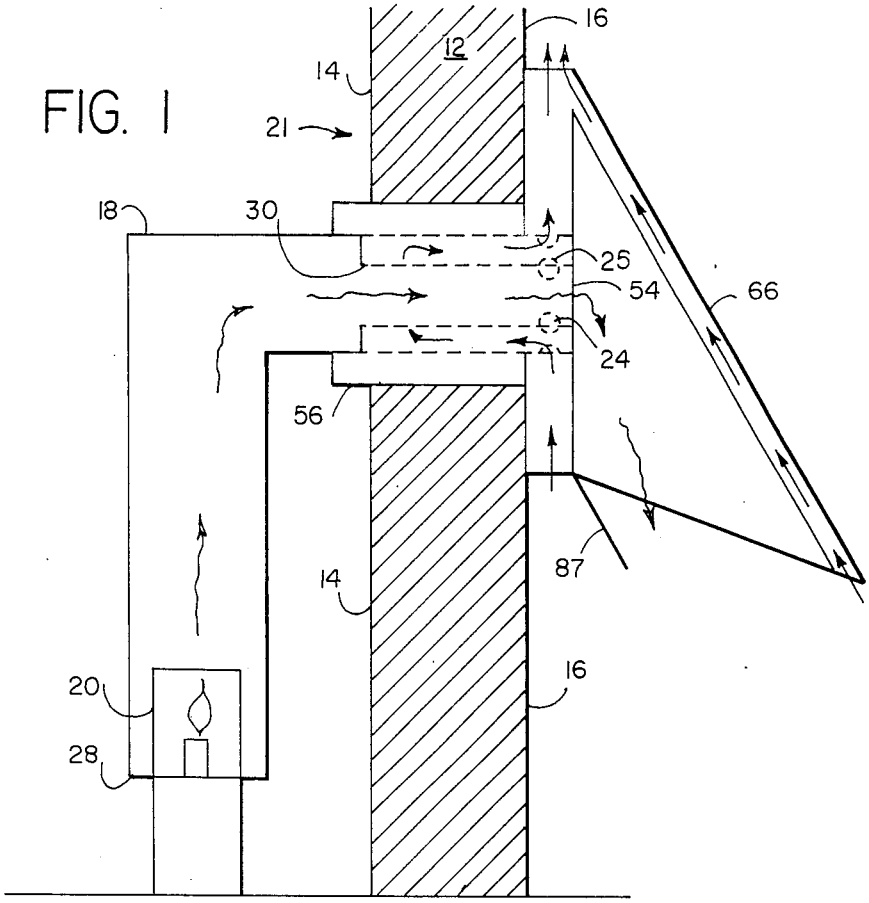
FIG. 1 is a cross-sectional view of the venting system.
Figure 3:
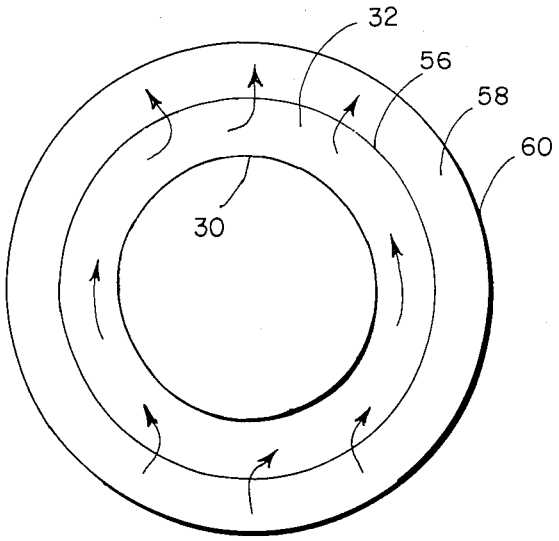
FIG. 3 is a front view of the flue pipe and first and second sleeve combination.

Referring now to the drawings wherein like numerals correspond to like parts throughout, there is illustrated in FIG. 1 the venting system 10 of the present invention. The venting system is inserted through a wall 12 of a building 21. The wall 12 includes an interior surface 14 and an exterior surface 16. An exhaust pipe 18 is connected to the combustion source of an appliance 20, which may be a combustion chamber associated with, for example, a furnace, a hot water heater or any other such system. The construction of the combustion source does not form a part of this invention.

Combustion gases 22 generated in the combustion source of the appliance 20 are passed from the combustion source, which is inside of the building 21, through exhaust pipe 18 to the atmosphere outside of the building 21. The exhaust pipe 18 may extend from the combustion chamber 20 upwards, to a certain point and then is connected to flue pipe 56, through a right-hand angle, which extends through the wall 12 and connects outside the building 21 to the vent hood 66. The end of the exhaust pipe 18 is connected to the apparatus of the instant invention such that combustion gases flow to the vent hood 66 through a reduced diameter opening 54 formed by a first sleeve 30 in flue pipe 56.

Figure 2:
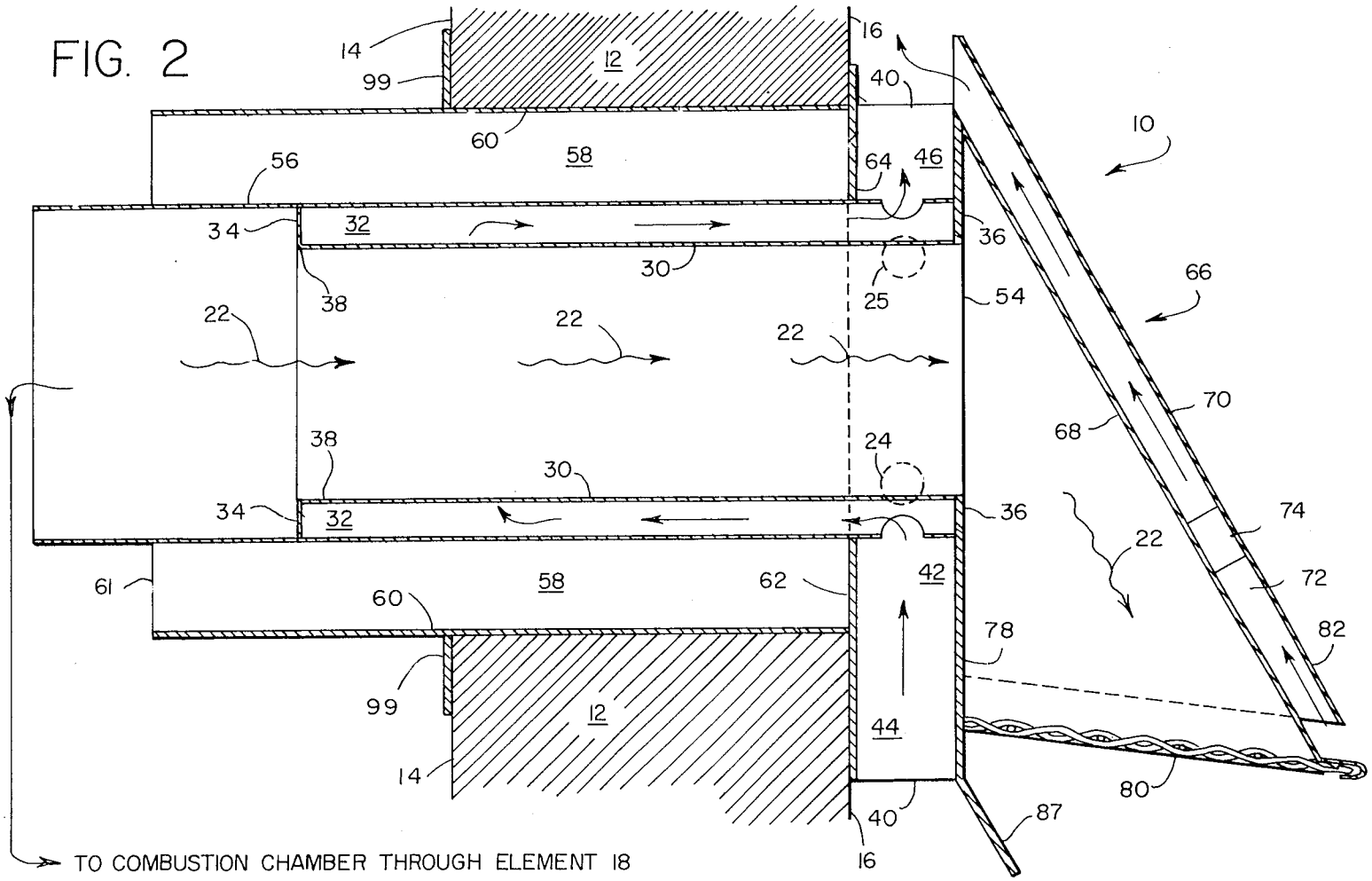
FIG. 2 is a cross-sectional view of the flue pipe and vent hood.

As shown in more detail in FIG. 2, an inner cylindrical sleeve 30 is placed within the exhaust pipe 56. The placement of the sleeve 30 in exhaust pipe 56 forms a first annulus 32 which has an inner end 34 which extends a distance inside the building and an outer end 36 proximate to the vent hood 66. The inner cylindrical sleeve 30 opens to the vent hood 66. The inner end 34 of the annulus is sealed by a first sealing ring 38. That first sealing ring 38 is disposed within and concentric with the exhaust pipe 56 and is in fluid connection with the inner end of the exhaust pipe 18. The outer end 36 of the inner sleeve 30 is open to the area outside of the building through opening 54 to the vent hood 66. A plate 78 seals the end of the exhaust pipe 56 and also forms the rear wall of the vent hood 66.

Both the exhaust pipe 56 and the inner sleeve 30 extend outside the exterior surface 16 of the building. The outer circumference of the exhaust pipe 56 has a plurality of openings 24 and 25 formed therein. Those openings 24 and 25 allow air from the area outside of the exterior surface 16 of the building to flow therein in order to cool the outside surface of the inner sleeve 30 through which the flue gases exit to the vent hood 66. In order to promote a vertical airflow into openings 24 and out from hole 25, a plate 64 is disposed and spaced a distance away from the plate 78. The plates 64 and 78 form a two-sided divider plate. Plate 64 also serves to seal the outer cylindrical sleeve 56 from the outside environment.

The plate 64 is spaced away from the plate 78 by means of sides 40. Thus, the plates 64 and 78 and the two sides 40 form a rectangular cross-sectional air passage 42, which is open at the top and bottom, through which ambient air is caused to flow vertically, thus providing a continuous flow of outside air to openings 24.

The lower portion 87 of plate 64 is bent away from the building 16 to divert exhaust gases away from building and allow cool outside air to enter air passage 42.

The air passage 42 is in communication with openings 24 to first annulus 32 so that air passing through the air passage 42 passes into the first annulus 32. Air passage 42 has a lower portion 44 to input cool air and an upper portion 46 to expel hot air. The plate 64 is in contact with the exterior surface 16 of the building. The plate 78 is in contact with the vent hood 66 and is cooled by this same air flow and contribute to the natural convection in passage 42.

An outer cylindrical sleeve 60 partially surrounds the flue pipe 56, forming a second annulus 58. The second annulus 58 has an inner end 61 and an outer end 62. The outer end 61 is sealed by the plate 64 at the exterior surface 16. The inner end 60 is open to the area inside the interior surface 14. That outer sleeve 60 may be omitted in order to permit a smaller opening in the wall 12 when that wall is comprised of non-combustible material, such as masonry. An inner liner 99 at surface 14 is used to seal the wall opening at the sleeve 60.

The second annulus 58 may have openings or holes at the exterior surface 62, thereby providing a conduit for air to flow into the room for combustion.

The vent hood 66 of the present invention, under which spent combustion gases 22 are discharged, is secured to divider plate 78 and has a three-sided inner hood 68 and a three-sided outer hood 70. A cooling passage 72 is located between the inner hood 68 and the outer hood 70. At least one spacer 74 separates and supports the inner hood 68 from the outer hood 70. The outer hood 70 has a lower screened portion 80 through which the combustion gases 22 are expelled. That construction allows a natural convection process to provide cooling air which rises through passage 72, thus removing convective and radiant heat from the inner hood 68. The present construction reduces the temperature of the outer hood 70 to approximately 130° F., thereby greatly increasing the safety of the vent hood 66 in the event someone should touch or fall against the outer surface.

In operation, the hot combustion gases 22 are passed through the exhaust pipe 18 into the inner sleeve 30 of the flue pipe 56. The combustion gases 22 are at a temperature of approximately 350° F. The heat from the combustion gases 22 is conducted to the inner sleeve 30, thereby raising the temperature of the inner sleeve 30 to near 350° F.

Air is inputted into the air passage 42 through the lower of the holes 24 and into the first annulus 32. As the air in the first annulus 32 is heated, it rises by natural convection currents and then exits through the top openings 25 in the exhaust pipe 18.

The air in the second annulus 58 is in communication with the air within the building 21. Thus, the cool air from within the building 21 in that annulus provides a further cooling effect on the outer sleeve 60 and the exhaust pipe 56. As the air is heated, it rises by a convection process and is expelled through the inner end 61. Optional further cooling may be effected by having the second annulus 58 open at its outer end 62 thereby providing a cool stream of air into the second annulus 58. That outer air may also advantageously be used for combustion purposes.

Combustion gases 22 exit from the flue pipe 56 and are expelled through the lower screened portion 80 of the vent hood 66. Cool air is inputted into the cooling passage 72 at its lower portion 82 and then rises by natural convection through passage 72 and exits at the upper portion of the passage 42 formed by the plates 64 and 78 and the sides 40. The passage of this cool air serves to cool the outer hood portion 70 of the vent hood 66.

Although only a preferred embodiment is specifically illustrated and described herein, it will be appreciated that many modifications and variations of the present invention are possible within the purview of the appended claims without departing from the spirit and intended scope of the invention.

What is claimed is:

1. A venting system for venting the products of combustion from a combustion process within a building to the outside atmosphere, comprising:

a flue pipe adapted for the passage of combustion gases therein having a first end and a second end, said first end being in communication with said combustion process;

an inner cylindrical sleeve, concentric with and disposed within said flue pipe so as to define a first annulus between said inner sleeve and said flue pipe;

an outer cylindrical sleeve, concentric with and surrounding said flue pipe so as to define a second annulus between said outer sleeve and said flue pipe; and a vent hood in fluid communication with said second end of said flue pipe.

2. The venting system of claim 1, wherein said flue pipe has a circumference and a plurality of holes are disposed about the circumference of said second end.

3. The venting system of claim 2, wherein said flue pipe is in fluid communication with an exhaust pipe which itself is in direct fluid communication with said combustion process, said exhaust pipe having a vertical section connected to said first end of said flue pipe at a first end thereof and said flue pipe having a horizontal section with said second end of said flue pipe at a second end thereof;

said horizontal section extends through a wall in said building;

said wall having an interior surface and an exterior surface; and said vent hood is disposed on said exterior surface of said wall.

4. The venting system of claim 3, further comprising:

divider plate means having a first plate and a second plate, said first plate and said second plate being spaced apart to form a passage therebetween;

said first plate of said divider plate means being in communication with said exterior surface of said wall and said second plate of said divider plate means being in communication with said vent hood; and said divider plate means surrounds said flue pipe and said flue pipe extends through the wall and the divider plate means.

5. The venting system of claim 4, wherein said first annulus has an inner end proximate to the vertical section of said flue pipe and an outer end proximate to said vent hood and said second annulus has an inner end proximate to the vertical section of said flue pipe and an outer end proximate to said vent hood and further comprises:

a first sealer ring within said flue pipe and in communication with said inner end of said first annulus so as to seal said inner end of said first annulus; and a second sealer ring surrounding said flue pipe and in communication with said outer end of said second annulus so as to seal said outer end of said second annulus.

6. The venting system of claim 4, wherein said vent hood comprises:

an inner hood, attached to said divider plate means, said inner hood having a lower screened portion and an upper portion; and an outer hood, attached to said divider plate means and disposed without said inner hood so as to form a cooling passage therebetween, said outer hood having a lower screened portion and an upper portion.

7. A venting system for venting the products of combustion from a combustion chamber within a building to the outside atmosphere, comprising:

a flue pipe adapted for passage of said combustion gases therein, said flue pipe comprising an exhaust plate having a vertical section and a horizontal section, said vertical section being in communication with said combustion chamber and said horizontal section having a first end connected to said vertical section and a second end, said horizontal section extending through an opening in a wall of said building;

an inner cylindrical sleeve, concentric with and disposed within said flue pipe so as to define a first annulus between said inner sleeve and said flue pipe;

an outer cylindrical sleeve, concentric with and surrounding said flue pipe so as to define a second annulus between said outer sleeve and said flue pipe; and a vent hood in communication with said second end of said horizontal section of said flue pipe.

8. The venting system of claim 7, wherein said flue pipe has a circumference and a plurality of holes are disposed about the circumference of said second end of said horizontal section.

9. The venting system of claim 8, further comprising:

divider plate means having a first plate and a second plate, said first plate and said second plate being spaced apart to form a passage therebetween;

said first plate of said divider plate means being in communication with said exterior surface of said wall and said second plate of said divider plate means being in communication with said vent hood; and said divider plate means surrounds said flue pipe and said flue pipe extends through the wall and the divider plate means.

10. The venting system of claim 9, wherein said first annulus has an inner end proximate to the vertical section and an outer end proximate to the vent hood and said second annulus has an inner end proximate to said vertical section and an outer end proximate to said vent hood and further comprises:

a first sealer ring within said flue pipe and in communication with said inner end of said first annulus so as to seal said inner end of said first annulus; and a second sealer ring surrounding said flue pipe and in communication with said outer end of said second annulus so as to seal said outer end of said second annulus.

11. The venting system of claim 9, wherein said vent hood comprises:

an inner hood, attached to said divider plate means, said inner hood having a lower screened portion and an upper portion; and an outer hood, attached to said divider plate means and disposed without said inner hood, so as to form a cooling passage therebetween, said outer hood having a lower screened portion and an upper portion.

12. A venting system for venting the products of combustion from a combustion chamber within a building to the outside atmosphere, comprising:

a flue pipe adapted for passage of said combustion gases therein, said flue pipe comprising an exhaust pipe having a vertical section and a horizontal section, said horizontal section having a first end in communication with said vertical section and a second end and said flue pipe further having a circumference, said vertical section of said exhaust pipe being in communication with said combustion chamber and said horizontal section extends through a wall of said building, said flue pipe further having a plurality of holes on said horizontal section at the second end thereof about the circumference of said horizontal section;

an inner cylindrical sleeve, concentric with and disposed within said flue pipe so as to define a first annulus between said inner sleeve and said flue pipe;

an outer cylindrical sleeve, concentric with and surrounding said flue pipe so as to define a second annulus between said outer sleeve and said flue pipe; and a vent hood in communication with said horizontal end of said flue pipe.

13. The venting system of claim 12, further comprising:

divider plate having means having a first plate and a second plate, said first plate and said second plate being spaced apart to form a passage therebetween;

said first plate of said divider plate means being in communication with said exterior surface of said wall and said second plate of said divider plate means being in communication with said vent hood; and said divider plate means surrounds said flue pipe and said flue pipe extends through the wall and the divider plate means.

14. A venting system for venting the products of combustion from a combustion process within a building to the outside atmosphere, comprising:

a flue pipe having a circumference, said flue pipe comprising an exhaust pipe having a vertical section and a horizontal section having a first end in communication with said vertical section and a second end, said horizontal section having a plurality of holes disposed circumferentially about said second end thereof;

an inner cylindrical sleeve, concentric with and disposed within said flue pipe, so as to define a first annulus between said inner sleeve and said flue pipe; and an outer cylindrical sleeve, concentric with and surrounding said flue pipe, so as to define a second annulus between said outer sleeve and said flue pipe.

15. The venting system of claim 14, wherein said horizontal section extends through a wall of said building.

16. A venting system for venting the products of combustion from a combustion process within a building to the outside atmosphere, comprising:

a triangular-shaped inner hood, said inner hood having a lower screened portion, an upper portion secured to said lower screened portion at an angle and a side portion secured to both said upper and lower portions; and a triangular-shaped outer hood having an outer surface and being disposed without said inner hood so as to form a cooling passage therebetween in order to cool the outer surface of said outer hood.

17. The venting system of claim 16, further comprising: a spacer disposed between said inner hood and said outer hood.

18. The venting system of claim 17, wherein said inner hood and said outer hood are attached to an exterior surface of said building.

19. A venting system for venting the products of combustion from a combustion process within a building to the outside atmosphere, comprising:

a flue pipe adapted for the passage of combustion gases therein having a first end and a second end, said first end being in communication with said combustion process;

an inner cylindrical sleeve, concentric with and disposed within said flue pipe so as to define a first annulus between said inner sleeve and said flue pipe, said inner cylindrical sleeve being in fluid communication with said outside atmosphere at a first end and being closed at a second end such that outside air is drawn into and discharged from said first annulus between said inner sleeve and said flue pipe, thereby providing cooling for the surface of said flue pipe;

an outer cylindrical sleeve, concentric with and surrounding said flue pipe so as to define a second annulus between said outer sleeve and said flue pipe; and a vent hood in fluid communication with said second end of said flue pipe.

20. The venting system of claim 19, wherein said inner cylindrical sleeve is of a slightly smaller diameter than said flue pipe.

21. The venting system of claim 19, wherein said second end of said flue pipe has a plurality of holes disposed about its circumference which holes provide fluid communication of said outside atmosphere with said first annulus.

22. The venting system of claim 19, wherein said second annulus provides fluid communication between said outside atmosphere and the inside of said building.

* * * * *

UNITED STATES PATENT AND TRADEMARK OFFICE

CERTIFICATE OF CORRECTION

PATENT NO. : 4,765,308

DATED : August 23, 1988

INVENTOR(S) : John D. Marran

It is certified that error appears in the above-identified patent and that said Letters Patent is hereby corrected as shown below:

In the "SUMMARY AND OBJECTS OF THE INVENTION":

In Column 4, line 5, change "29020" to --290°--.

In the "DETAILED DESCRIPTION OF THE PREFERRED EMBODIMENT":

In Column 5, line 21, please add -- The vent hood 66 will be more fully disclosed below.--

Signed and Sealed this

Third Day of April, 1990

*Attest:*

HARRY F. MANBECK, JR.

*Attesting Officer*

*Commissioner of Patents and Trademarks*